US009091141B2

(12) United States Patent
Abasov et al.

(10) Patent No.: US 9,091,141 B2
(45) **Date of Patent: *Jul. 28, 2015**

(54) SYSTEMS AND METHODS FOR DYNAMICALLY DEVELOPING WELLBORE PLANS WITH A RESERVOIR SIMULATOR

(71) Applicant: Landmark Graphics Corporation, Houston, TX (US)

(72) Inventors: Shahin Abasov, Houston, TX (US); Alvin Stanley Cullick, Houston, TX (US); Ron Mossbarger, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 374 days.

This patent is subject to a terminal disclaimer.

(21) Appl. No.: 13/627,416

(22) Filed: Sep. 26, 2012

(65) Prior Publication Data

US 2013/0024174 A1 Jan. 24, 2013

Related U.S. Application Data

(63) Continuation of application No. 12/272,540, filed on Nov. 17, 2008, now Pat. No. 8,301,426.

(51) Int. Cl.
*G06G 7/48* (2006.01)
*E21B 43/00* (2006.01)

(52) U.S. Cl.
CPC ..... *E21B 43/00* (2013.01)

(58) Field of Classification Search
CPC ..... E21B 43/00
USPC ..... 703/10; 702/13; 166/66.5
See application file for complete search history.

(56) References Cited

U.S. PATENT DOCUMENTS

| | | | | |
|---|---|---|---|---|
| 6,549,879 | B1 * | 4/2003 | Cullick et al. | 703/10 |
| 7,096,172 | B2 * | 8/2006 | Colvin et al. | 703/10 |
| 2003/0173072 | A1 * | 9/2003 | Vinegar et al. | 166/66.5 |
| 2005/0149307 | A1 * | 7/2005 | Gurpinar et al. | 703/10 |
| 2005/0267718 | A1 | 12/2005 | Guyaguler et al. | |
| 2007/0299643 | A1 | 12/2007 | Guyaguler et al. | |
| 2008/0300793 | A1 * | 12/2008 | Tilke et al. | 702/13 |
| 2010/0057418 | A1 * | 3/2010 | Li et al. | 703/10 |

FOREIGN PATENT DOCUMENTS

CA 2643911 A1 9/2007

OTHER PUBLICATIONS

Zheng, Yi; First Notification of Office Action; Jul. 4, 2013; 7 pages; The State Intellectual Property Office of China; Beijing, China.
Zheng, Yi; Notification of Second Office Action; Feb. 25, 2014; 10 pages; The State Intellectual Property Office of China; Beijing, China.

(Continued)

*Primary Examiner* — Kandasamy Thangavelu
(74) *Attorney, Agent, or Firm* — Crain, Caton & James; John Wustenberg

(57) ABSTRACT

Systems and methods for dynamically developing a wellbore plan with a reservoir simulator. The systems and methods develop a plan for multiple wellbores with a reservoir simulator based on actual and potential reservoir performance.

28 Claims, 5 Drawing Sheets

(56) References Cited

OTHER PUBLICATIONS

Response to Office Action; 2 pages; Nov. 19, 2013; CN-KnowHow Intellectual Property Agent Limited; Beijing, China.

Response to Second Office Action; 5 pages; May 12, 2014; CN-KnowHow Intellectual Property Agent Limited; Beijing, China.

Matthew Batley, Patent Examination Report No. 1, Paten Application No. 2009314449, Dec. 4, 2014, 3 pages, Australian Government IP Australia, Australia.

* cited by examiner

SYSTEMS AND METHODS FOR DYNAMICALLY DEVELOPING WELLBORE PLANS WITH A RESERVOIR SIMULATOR

CROSS-REFERENCE TO RELATED APPLICATIONS

The priority of U.S. patent application Ser. No. 12/272,540, filed on Nov. 17, 2008, is hereby claimed and the specifications thereof are incorporated herein by reference.

STATEMENT REGARDING FEDERALLY SPONSORED RESEARCH

Not applicable.

FIELD OF THE INVENTION

The present invention generally relates to systems and methods for developing wellbore plans with a reservoir simulator. More particularly, the present invention relates to dynamically developing a plan for multiple wellbores with a reservoir simulator based on actual and potential reservoir performance.

BACKGROUND OF THE INVENTION

In the oil and gas industry, current practice in planning a multiple-well package for a field does not determine the optimal placement of the wellbores and their target completion zones based on the production from the field. In the current practice of simulating oil or gas production from a reservoir simulator, wells are planned external to the simulator through a manual procedure using two-dimensional net pay maps or other two-dimensional properties or, within a three-dimensional reservoir model, using static geological properties to guide the selection. A wellbore plan may include: i) true wellbore geometry/trajectory; ii) wellbore tieback connections to pipelines and delivery systems; and iii) optimal formation perforation zones with true production from the dynamic flow of oil, gas, and water.

In U.S. Pat. No. 7,096,172, for example, automated well target selection is based on static properties of the geologic formation. The identified locations are not updated from actual reservoir performance fluid flow, that is, oil, water, or gas production or injection. Similar disadvantages are described in "Optimal Field Development Planning of Well Locations with Reservoir Uncertainty" by A. S. Cullick, K. Narayanan, and S. Gorell, wherein a component of the planning process is automated by optimizing movement of perforation zones utilizing a reservoir simulator to evaluate field production. However, this approach does not address optimizing and simultaneously i) verifying wellbore drillability hazards and ii) computing updates to x) true well geometry/trajectory; y) tie-back connections to pipelines and delivery systems; and z) optimal formation perforation zones with true production from the dynamic flow of oil, gas, and water. This approach also requires a completed simulation prior to updating potential locations, which is costly in terms of computer resources and time.

Therefore, there is a need for a different dynamic approach to developing a plan for multiple wellbores with a reservoir simulator that considers actual and potential reservoir performance and updates the wellbore plan as it is being developed. There is also a need for a new approach to developing a plan for multiple wellbores with a reservoir simulator that considers wellbore hazards and updates the wellbore plan during a simulation run.

SUMMARY OF THE INVENTION

The present invention therefore, meets the above needs and overcomes one or more deficiencies in the prior art by providing systems and methods for developing wellbore plans with a reservoir simulator based on actual and potential reservoir performance.

In one embodiment, the present invention includes a computer implemented method for developing wellbore plans with a reservoir simulator, comprising: i) creating a drainable volume indicator for each group of connected grid cells in a gridded reservoir model; ii) calculating a value on a computer system for each drainable volume identified by its drainable volume indicator; iii) selecting each drainable volume that has a value up to a predetermined maximum value; and iv) connecting contiguous selected drainable volumes on the computer system.

In another embodiment, the present invention includes a non-transitory program carrier device carrying computer executable instructions for developing wellbore plans with a reservoir simulator. The instructions are executable to implement: i) creating a drainable volume indicator for each group of connected grid cells in a gridded reservoir model; ii) calculating a value for each drainable volume identified by its drainable volume indicator; iii) selecting each drainable volume that has a value up to a predetermined maximum value; and iv) connecting contiguous selected drainable volumes.

In yet another embodiment, the present invention includes computer implemented method for validating wellbore plans for new wells, comprising: i) eliminating each new well with a constraint value outside a filter range criteria; ii) ranking each new well that is not eliminated, using a computer system, according to a drainable connected oil in place and a difference between a maximum oil rate and a deltaPressure, using a weight factor; and iii) selecting a best new well from the ranked new wells.

In yet another embodiment, the present invention includes a non-transitory program carrier device carrying computer executable instructions for validating wellbore plans for new wells. The instructions are executable to implement: i) eliminating each new well with a constraint value outside a filter range criteria; ii) ranking each new well that is not eliminated according to a drainable connected oil in place and a difference between a maximum oil rate and a deltaPressure, using a weight factor; and iii) selecting a best new well from the ranked new wells.

Additional aspects, advantages and embodiments of the invention will become apparent to those skilled in the art from the following description of the various embodiments and related drawings.

BRIEF DESCRIPTION OF THE DRAWINGS

The present invention is described below with references to the accompanying drawings in which like elements are referenced with like reference numerals, and in which.

DETAILED DESCRIPTION OF THE PREFERRED EMBODIMENTS

The subject matter of the present invention is described with specificity, however, the description itself is not intended to limit the scope of the invention. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order.

System Description

The present invention may be implemented through a computer-executable program of instructions, such as program modules, generally referred to as software applications or application programs executed by a computer. The software may include, for example, routines, programs, objects, components, and data structures that perform particular tasks or implement particular abstract data types. The software forms an interface to allow a computer to react according to a source of input. NEXUS™, which is a commercial software application marketed by Landmark Graphics Corporation, may be used as an interface application to implement the present invention. The software may also cooperate with other code segments to initiate a variety of tasks in response to data received in conjunction with the source of the received data. The software may be stored and/or carried on any variety of memory media such as CD-ROM, magnetic disk, bubble memory and semiconductor memory (e.g., various types of RAM or ROM). Furthermore, the software and its results may be transmitted over a variety of carrier media such as optical fiber, metallic wire, free space and/or through any of a variety of networks such as the Internet.

Moreover, those skilled in the art will appreciate that the invention may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present invention. The invention may be practiced in distributed-computing environments where tasks are performed by remote-processing devices that are linked through a communications network. In a distributed-computing environment, program modules may be located in both local and remote computer-storage media including memory storage devices. The present invention may therefore, be implemented in connection with various hardware, software or a combination thereof, in a computer system or other processing system.

Figure 1:
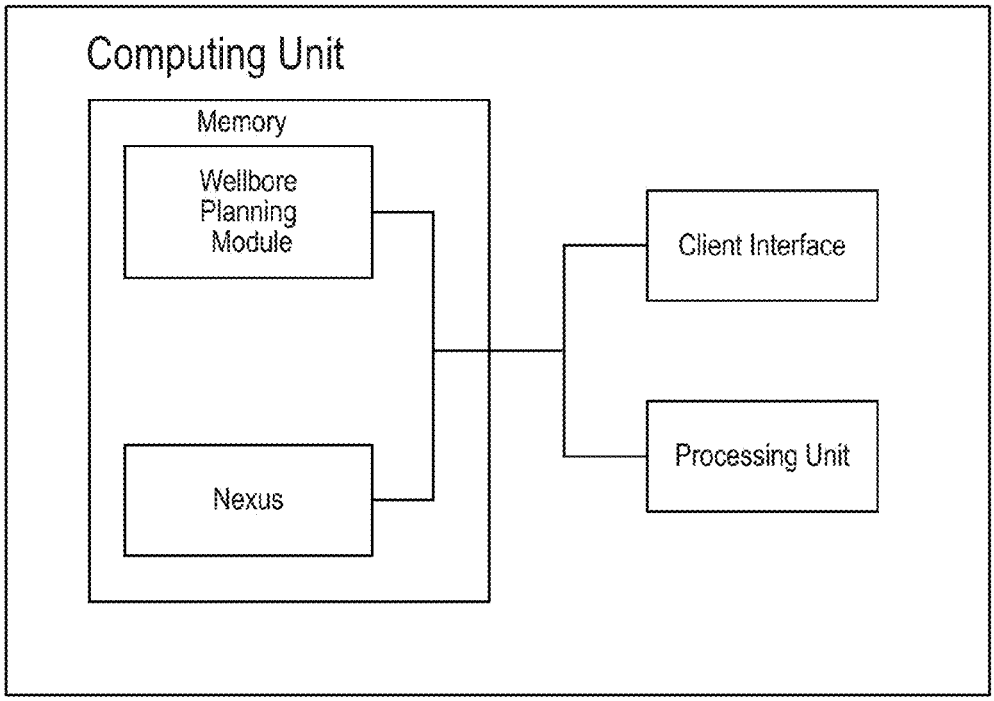
FIG. 1 is a block diagram illustrating a system for implementing the present invention.

Referring now to FIG. 1, a block diagram of a system for implementing the present invention on a computer is illustrated. The system includes a computing unit, sometimes referred to as computing system, which contains memory, application programs, a client interface, and a processing unit. The computing unit is only one example of a suitable computing environment and is not intended to suggest any limitation as to the scope of use or functionality of the invention.

Figure 2A:
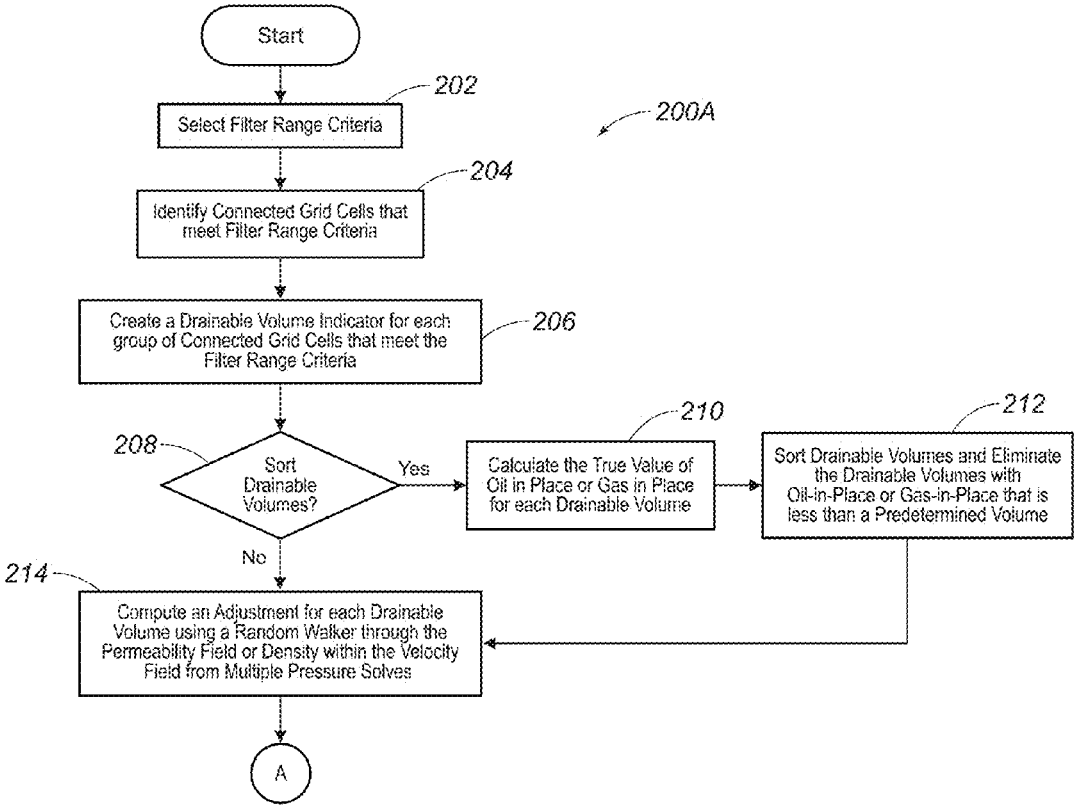
FIG. 2A is a flow diagram illustrating one embodiment of a method for implementing the present invention.
Figure 2B:
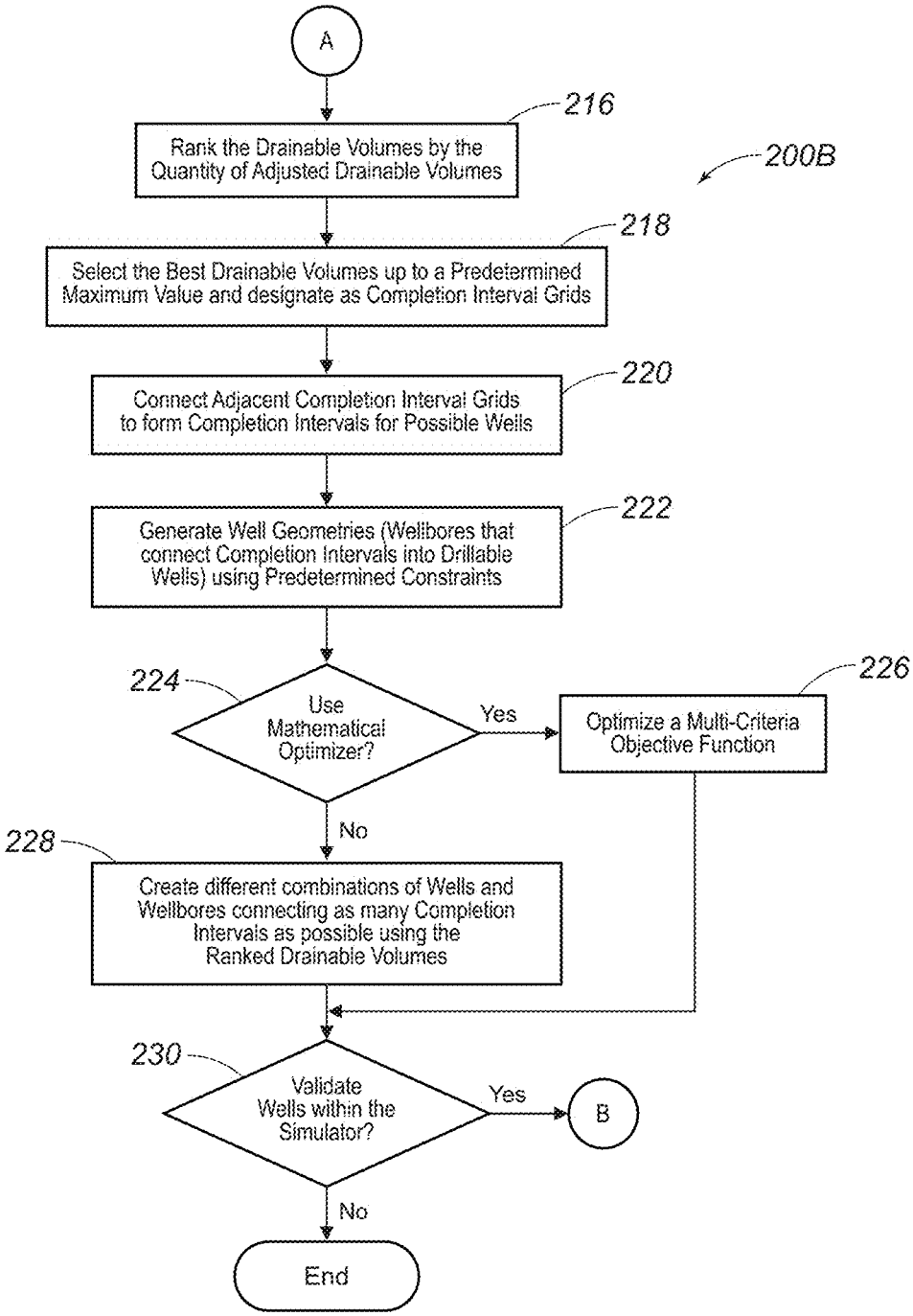
FIG. 2B is a continuation of the method illustrated in FIG. 2A.
Figure 3:
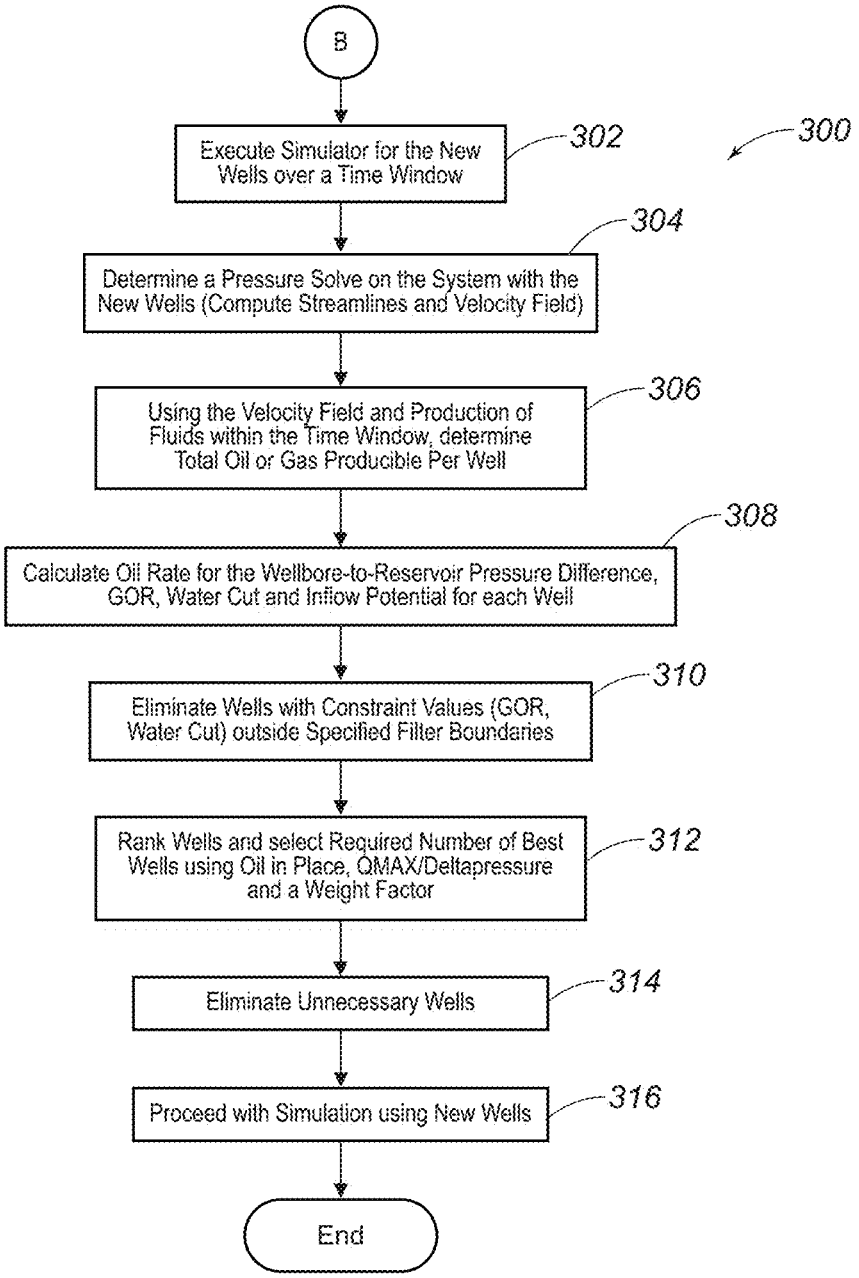
FIG. 3 is a flow diagram illustrating another embodiment of a method for implementing the present invention.

The memory primarily stores the application programs, which may also be described as program modules containing computer-executable instructions, executed by the computing unit for implementing the methods described herein and illustrated in FIGS. 2A-3. The memory therefore, includes a wellbore planning module, which enables the methods illustrated and described in reference to FIGS. 2A-3, and NEXUS™.

Although the computing unit is shown as having a generalized memory, the computing unit typically includes a variety of computer readable media. By way of example, and not limitation, computer readable media may comprise computer storage media and communication media. The computing system memory may include computer storage media in the form of volatile and/or nonvolatile memory such as a read only memory (ROM) and random access memory (RAM). A basic input/output system (BIOS), containing the basic routines that help to transfer information between elements within the computing unit, such as during start-up, is typically stored in ROM. The RAM typically contains data and/or program modules that are immediately accessible to and/or presently being operated on by the processing unit. By way of example, and not limitation, the computing unit includes an operating system, application programs, other program modules, and program data.

The components shown in the memory may also be included in other removable/nonremovable, volatile/nonvolatile computer storage media. For example only, a hard disk drive may read from or write to nonremovable, nonvolatile magnetic media, a magnetic disk drive may read from or write to a removable, non-volatile magnetic disk, and an optical disk drive may read from or write to a removable, nonvolatile optical disk such as a CD ROM or other optical media. Other removable/non-removable, volatile/non-volatile computer storage media that can be used in the exemplary operating environment may include, but are not limited to, magnetic tape cassettes, flash memory cards, digital versatile disks, digital video tape, solid state RAM, solid state ROM, and the like. The drives and their associated computer storage media discussed above therefore, store and/or carry computer readable instructions, data structures, program modules and other data for the computing unit.

A client may enter commands and information into the computing unit through the client interface, which may be input devices such as a keyboard and pointing device, commonly referred to as a mouse, trackball or touch pad. Input devices may include a microphone, joystick, satellite dish, scanner, or the like.

These and other input devices are often connected to the processing unit through the client interface that is coupled to a system bus, but may be connected by other interface and bus structures, such as a parallel port or a universal serial bus (USB). A monitor or other type of display device may be connected to the system bus via an interface, such as a video interface. In addition to the monitor, computers may also include other peripheral output devices such as speakers and printer, which may be connected through an output peripheral interface.

Although many other internal components of the computing unit are not shown, those of ordinary skill in the art will appreciate that such components and their interconnection are well known.

Method Description

The following description is separated into two stages: i) ranking/design; and ii) validation. Each stage may be processed within a reservoir simulator-like NEXUS™—however, the ranking and design stage may be processed outside the simulator before the results are validated with the simulator.

Referring now to FIG. 2A, the method 200A is the beginning of the ranking/design stage.

In step 202, the filter range criteria are selected. One or more filter range criteria may be selected such as, for example: i) bounds on oil or gas volume; ii) permeability; iii) fluid saturation; iv) phase permeability; v) minimum transmissibility; vi) minimum permeability; vii) minimum oil saturation (SO) and/or gas saturation (SG); viii) maximum gas-oil-ratio (GOR); ix) maximum water cut (WCUT); x) minimum mobile SO or SG; and xi) minimum injectivity index for injection wells.

Figure 4:
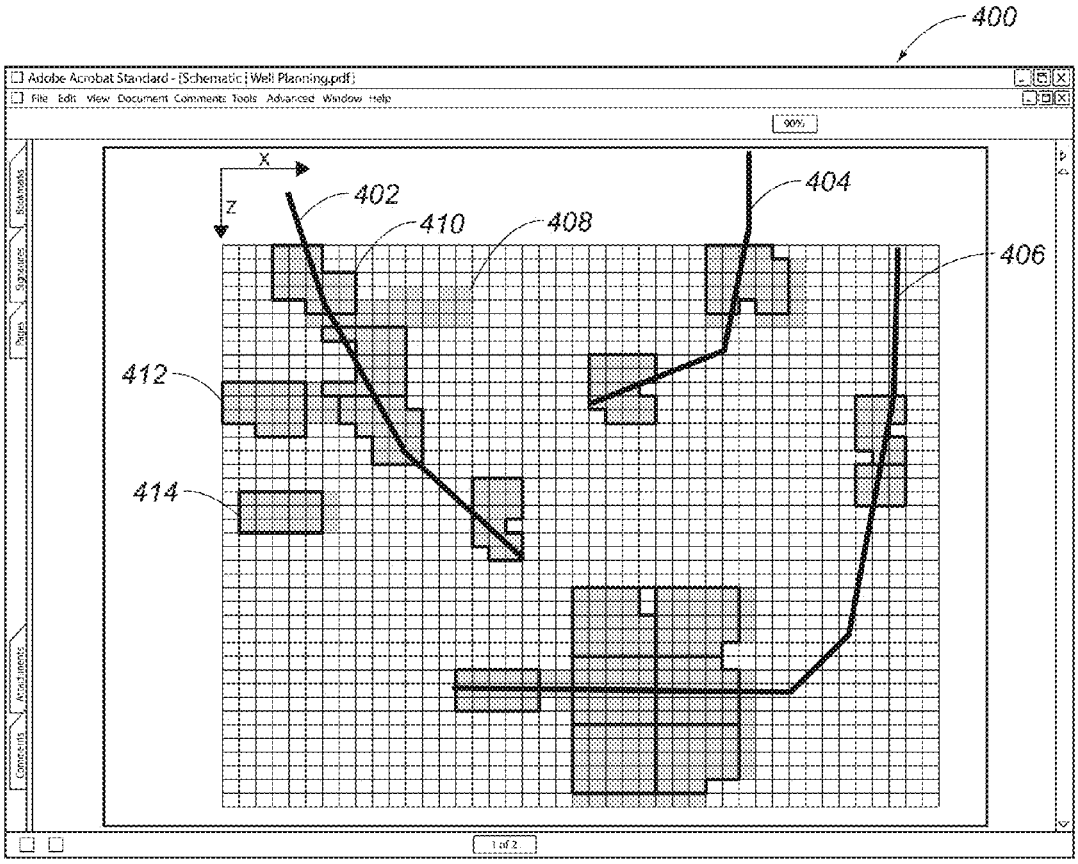
FIG. 4 is a display of a wellbore plan developed according to the method illustrated in FIGS. 2A-2B.

In step 204, the connected grid cells that meet the selected filter range criteria are identified, for example, in a display. In FIG. 4, the display 400 is a two-dimensional vertical cross-section illustrating various wellbores 402, 404, 406 passing through a gridded reservoir model. These wellbores are commonly referred to as deviated and horizontal wells. The shaded areas identify potential reservoir pay, which are the connected grid cells that meet the selected filter range criteria. In the display 400, for example, the connected grid cells 408 meet the filter range criteria.

In step 206, a drainable volume indicator is created for each group of connected grid cells identified in step 204. For each group of connected grid cells, a drainable volume indicator is created by eliminating grid cells within the group of connected grid cells that do not meet a minimum predetermined permeability and mobile oil fraction within a specified radius. Each drainable volume indicator defines the parameters of a drainable volume within the reservoir.

In step 208, determine if the drainable volumes identified by each drainable volume indicator in step 206 should be sorted. If the drainable volumes should be sorted, then the method 200A proceeds to step 210. If the drainable volumes should not be sorted, then the method 200A proceeds to step 214.

In step 210, the true value of oil-in-place or gas-in-place is calculated for each drainable volume. Techniques and algorithms for calculating the true value of oil-in-place or gas-in-place are well known in the art. The true value of oil-in-place for compositional or enhanced black oil simulations should be calculated, for example, as a sum of oil in liquid and gas phases. An input to the calculation is the drainage radius for each well.

In step 212, the drainable volumes are sorted from high to low using the true value for oil-in-place or gas-in-place calculated in step 210 for each drainable volume, and each drainable volume with a calculated oil-in-place or gas-in-place that is less than a predetermined volume of oil-in-place or gas-in-place is eliminated. Sorting and eliminating drainable volumes in this manner is optional depending on whether the drainable volumes should meet a preferred predetermined volume of oil-in-place or gas-in-place.

In step 214, an adjustment value for each drainable volume is calculated based on i) a distance from a boundary, such as a fluid contact (water-oil contact), geologic fault, or top geologic boundary, and ii) a tortuosity of a connected volume, which relates to the resistance to flow over a distance. The adjustment value is computed by using a Random Walker through the permeability field or a density within the velocity field from multiple pressure solves. The Random Walker distance to the boundary is an indicator for the tortuous flow path of fluids to a drainable volume boundary. Likewise, density within the velocity field is an indicator for the tortuous path of fluids to a drainable volume boundary. The Random Walker distance and density within the velocity field are both well known in the art as indicators for the tortuous path of fluids to a drainable volume boundary.

Referring now to FIG. 2B, the method 200B is a continuation of the method 200A for implementing the ranking/design stage.

In step 216, the drainable volumes are ranked based on each adjustment value for the drainable volumes calculated in step 214. The drainage volumes therefore, may be ranked from a highest adjustment value to a lowest adjustment value or vice versa.

In step 218, the drainable volumes that have an adjustment value up to a predetermined maximum adjustment value are selected and each are designated as a completion interval grid in the display 400. As shown in the display 400, multiple completion interval grids (410, 412, 414, 416, 418, 420, 422, 424, 426, 428, 430, 432, 434, 436, 438, 440, 442) are represented by the shaded connected grid cells that are bound by a single line.

In step 220, each contiguous completion interval grid is connected to form completion intervals for possible wells. Each completion interval grid includes multiple gridblocks. Each gridblock includes many gridlock properties, which may include velocity information. In the display 400, one completion interval is represented by the contiguous group of completion interval grids 416, 418. Another completion interval is represented by the contiguous group of completion interval grids 424, 426, 428, 430, 432, 434. And, a third completion interval is represented by the contiguous group of completion interval grids 436, 438. Likewise, the non-contiguous completion interval grids (401, 412, 414, 420, 422, 440, 442) each represent an independent completion interval. Each completion interval represents a potential path for wellbore.

In step 222, well geometries (i.e. potential wellbores that may connect completion intervals into drillable wells) are generated within predetermined constraints—which may include well characteristics such as, for example: i) selection of a well type such as vertical, horizontal, deviated, or multilateral; ii) well lateral length; iii) turn radius; iv) kick-off point; v) Kelly Bushing; vi) elevation/location; vii) surface connection node locations; viii) well spacing and well number; ix) fault locations and fluid boundaries; x) radius for drainage volume; xi) weight factor for maximum oil rate (QMAX) and original oil-in-place (OIP); and xii) platform, gathering center or drill center locations. The use of these characteristics, and others, to generate wellbores is well known in the art. The use of these characteristics, and other wellbore hazard indicators, to develop and update a plan for multiple wellbores with a reservoir simulator is not well known in the art, however.

In step 224, determine if a mathematical optimizer is preferred to develop different combinations of wells and wellbores for connecting as many of the completion intervals as possible. If a mathematical optimizer is preferred, then the method 200B proceeds to step 226. If a mathematical optimizer is not preferred, then the method 200B proceeds to step 228.

In step 226, a mathematical optimizer is used to optimize a multi-criteria objective function, which may include techniques well known in the art for maximizing the connection of completion intervals using different combinations of wells and wellbores, subject to the well geometry predetermined constraints in step 222, while minimizing the drilling cost of each anticipated well.

In step 228, different combinations of wells and wellbores are developed (planned) by connecting as many completion intervals as possible using the drainable volumes selected in step 218, subject to the well geometry predetermined constraints in step 222, and their ranked adjustment value in step 216. In the display 400, wellbores 402, 404, 406 are generated with respect to the well geometry predetermined constraints. Completion intervals 412, 414 are not included in a wellbore path (402, 404, 406) potentially because of the well geometry predetermined constraints in step 222 and/or potentially because their adjustment value was not ranked high or low enough. Alternatively, completion intervals 412, 414 may not have been included in a wellbore path (402, 404, 406) because of the results in step 226. Due to the well geometry predetermined constraints in step 222 and/or the results in step 226, three (3) separate wells are used at the surface to produce the respective wellbores 402, 404, 406 in FIG. 4.

In step 230, determine if validation of the wells within the simulator is preferred. If validation is not preferred, then the method 200B ends. If validation is preferred, then the method 200B continues to step 302 in FIG. 3.

Referring now to FIG. 3, the method 300 is a continuation of the method 200B for implementing the validation stage.

In step 302, the simulator is run a first time for the new wells represented by wellbores 402, 404, 406 in display 400 over a preferred time window. The time window is preferably predetermined by the user based on subjective criteria.

In step 304, a pressure solve on the system is calculated using the new wells. The pressure solve is calculated by computing streamlines using techniques well known in the art.

In step 306, the pressure solve in step 304 is used to calculate the total oil or gas producible for each new well within the time window using techniques well known in the art.

In step 308, the oil rate for the wellbore-to-reservoir pressure difference, GOR, WCUT, and inflow potential (productivity index) are calculated within the time window for each new well.

In step 310, the results calculated in steps 306 and 308 are used as constraint values for the new wells to eliminate new wells with constraint values outside specified filter range criteria.

In step 312, rank the remaining new wells and select the best new wells using a ranking of drainable connected oil in place, then a ranking of maximum oil rate/deltaPressure difference, and then applying a weight factor.

In step 316, proceed with the simulation using the best new wells.

While the present invention has been described in connection with presently preferred embodiments, it will be understood by those skilled in the art that it is not intended to limit the invention to those embodiments. The present invention, for example, is not limited to oil and gas wells, but is applicable to drilling of subterranean wells in other contexts, for example for contaminant disposal, fresh water production, and carbon sequestration. It is therefore, contemplated that various alternative embodiments and modifications may be made to the disclosed embodiments without departing from the spirit and scope of the invention defined by the appended claims and equivalents thereof.

The invention claimed is:

1. A method for developing wellbore plans with a reservoir simulator, comprising:

creating, on a computer system, a drainable volume indicator for each group of connected grid cells in a gridded reservoir model;

calculating a value on the computer system for each drainable volume identified by its drainable volume indicator;

selecting, on the computer system, each drainable volume that has a value up to a predetermined maximum value; and connecting, on the computer system, contiguous selected drainable volumes.

2. The method of claim 1, wherein each group of connected grid cells meets a preselected filter range criteria comprising reservoir performance values.

3. The method of claim 1, wherein each value represents an adjustment value that is based on a distance from a boundary and a tortuosity of a connected drainable volume.

4. The method of claim 1, further comprising ranking each drainable volume based on its value.

5. The method of claim 4, further comprising generating wellbore geometries subject to one or more predetermined constraints.

6. The method of claim 5, further comprising developing a wellbore plan by maximizing a connection of the connected drainable volumes, subject to the wellbore geometries, using the selected drainable volumes and their respective values.

7. The method of claim 5, further comprising developing a wellbore plan by maximizing a connection of the connected drainable volumes, subject to the wellbore geometries, and minimizing a cost to drill each wellbore.

8. The method of claim 1, further comprising calculating a true value of oil in place or gas in place for each drainable volume.

9. The method of claim 8, further comprising:

sorting each drainable volume using a calculated true value of oil in place or gas in place for each drainable volume; and eliminating each drainable volume wherein the calculated true value of oil in place or gas in place is less than a predetermined volume of oil in place or gas in place.

10. The method of claim 1, wherein the drainable volume indicator is created by eliminating connected grid cells within each group of connected grid cells that do not meet a minimum predetermined permeability and mobile oil fraction within a specified radius.

11. A non-transitory program carrier device carrying computer executable instructions for developing wellbore plans with a reservoir simulator, the instructions being executable to implement:

creating a drainable volume indicator for each group of connected grid cells in a gridded reservoir model;

calculating a value for each drainable volume identified by its drainable volume indicator;

selecting each drainable volume that has a value up to a predetermined maximum value; and connecting contiguous selected drainable volumes.

12. The program carrier device of claim 11, wherein each group of connected grid cells meets a preselected filter range criteria comprising reservoir performance values.

13. The program carrier device of claim 11, wherein each value represents an adjustment value that is based on a distance from a boundary and a tortuosity of a connected drainable volume.

14. The program carrier device of claim 11, further comprising ranking each drainable volume based on its value.

15. The program carrier device of claim 14, further comprising generating wellbore geometries subject to one or more predetermined constraints.

16. The program carrier device of claim 15, further comprising developing a wellbore plan by maximizing a connection of the connected drainable volumes, subject to the wellbore geometries, using the selected drainable volumes and their respective values.

17. The program carrier device of claim 15, further comprising developing a wellbore plan by maximizing a connection of the connected drainable volumes, subject to the wellbore geometries, and minimizing a cost to drill each wellbore.

18. The program carrier device of claim 11, further comprising calculating a true value of oil in place or gas in place for each drainable volume.

19. The program carrier device of claim 18, further comprising:

sorting each drainable volume using a calculated true value of oil in place or gas in place for each drainable volume; and eliminating each drainable volume wherein the calculated true value of oil in place or gas in place is less than a predetermined volume of oil in place or gas in place.

20. The program carrier device of claim 11, wherein the drainable volume indicator is created by eliminating connected grid cells within each group of connected grid cells that do not meet a minimum predetermined permeability and mobile oil fraction within a specified radius.

21. A method for validating wellbore plans for new wells, comprising:

eliminating, using a computer system, each new well with a constraint value outside a filter range criteria;

ranking, using the computer system, each new well that is not eliminated according to a drainable connected oil in place and a difference between a maximum oil rate and a deltaPressure, using a weight factor; and selecting, using the computer system, a best new well from the ranked new wells.

22. The method of claim 21, further comprising:

calculating at least one of total oil producible or total gas producible for each new well within a time window using a pressure solve.

23. The method of claim 22, further comprising:

calculating at least one oil rate, gas oil ratio, water cut and inflow potential for each new well.

24. The method of claim 23, wherein each constraint value for each new well is represented by one of the total oil producible, total gas producible, oil rate, gas oil ratio, water cut and inflow potential.

25. A non-transitory program carrier device carrying computer executable instructions for validating wellbore plans for new wells, the instructions being executable to implement:

eliminating each new well with a constraint value outside a filter range criteria;

ranking each new well that is not eliminated according to a drainable connected oil in place and a difference between a maximum oil rate and a deltaPressure, using a weight factor; and selecting a best new well from the ranked new wells.

26. The program carrier device of claim 25, further comprising:

calculating one of total oil producible or total gas producible for each new well within a time window using a pressure solve.

27. The program carrier device of claim 26, further comprising:

calculating at least one oil rate, gas oil ratio, water cut and inflow potential for each new well.

28. The program carrier device of claim 27, wherein each constraint value for each new well is represented by one of the total oil producible, total gas producible, oil rate, gas oil ratio, water cut and inflow potential.

* * * * *